US007207860B2

(12) United States Patent
Hornsby et al.

(10) Patent No.: US 7,207,860 B2
(45) Date of Patent: Apr. 24, 2007

(54) INTERACTIVE DISPENSING AMUSEMENT DEVICE

(75) Inventors: James R. Hornsby, St. Louis, MO (US); Marcellus R. Benson, St. Louis, MO (US); Joseph L. McGowan, St. Charles, MO (US); Timothy S. Brakensiek, St. Peters, MO (US); David Niehaus, St. Louis, MO (US)

(73) Assignee: JAKKS, Pacific, Inc., Malibu, CA (US)

( * ) Notice: Subject to any disclaimer, the term of this patent is extended or adjusted under 35 U.S.C. 154(b) by 0 days.

(21) Appl. No.: 10/325,173

(22) Filed: Dec. 20, 2002

(65) Prior Publication Data

US 2003/0124953 A1 Jul. 3, 2003

Related U.S. Application Data

(63) Continuation of application No. 09/777,143, filed on Feb. 5, 2001, now abandoned.

(60) Provisional application No. 60/180,360, filed on Feb. 4, 2000.

(51) Int. Cl.
*A63H 11/00* (2006.01)

(52) U.S. Cl. ..... 446/353; 446/431; 446/454; 446/465; 446/475

(58) Field of Classification Search ..... 446/475, 446/175, 272, 297, 330, 352, 353, 431, 435, 446/436, 438, 454, 456, 465, 290, 269, 483, 446/457; 221/298, 301, 185, 124, 154; 180/337
See application file for complete search history.

(56) References Cited

U.S. PATENT DOCUMENTS

| | | | | | |
|---|---|---|---|---|---|
| 2,479,488 | A | * | 8/1949 | Goldfarb | 446/298 |
| 3,120,079 | A | * | 2/1964 | Glass et al. | 446/191 |
| 3,264,782 | A | * | 8/1966 | Glass et al. | 446/435 |
| 3,383,792 | A | * | 5/1968 | Goldfarb | 446/376 |
| 3,479,101 | A | | 11/1969 | Poor et al. | |
| 4,226,292 | A | * | 10/1980 | Monte et al. | 180/6.5 |
| 4,280,809 | A | | 7/1981 | Greenberg et al. | |
| 4,556,392 | A | * | 12/1985 | Chang | 446/16 |
| 4,634,021 | A | * | 1/1987 | Davis | 221/3 |
| 4,654,659 | A | | 3/1987 | Kubo | |
| 5,055,082 | A | | 10/1991 | Varner | |
| 5,295,890 | A | * | 3/1994 | Myers | 446/176 |
| 5,392,953 | A | * | 2/1995 | Maldanis et al. | 221/97 |
| 5,456,626 | A | * | 10/1995 | Ming-Kang | 446/397 |
| 5,474,486 | A | * | 12/1995 | Chilton et al. | 446/456 |
| 5,575,515 | A | * | 11/1996 | Iwamoto et al. | 292/341.17 |
| 5,623,408 | A | * | 4/1997 | Motamedi et al. | 701/51 |
| 5,630,357 | A | * | 5/1997 | Akiyama | 99/323.6 |
| 5,816,887 | A | * | 10/1998 | Rudell et al. | 446/456 |
| 5,816,888 | A | * | 10/1998 | Myers | 446/456 |

* cited by examiner

*Primary Examiner*—Bena Miller
(74) *Attorney, Agent, or Firm*—Richard B. Klar; Law Office of Richard B. Klar

(57) ABSTRACT

The present invention provides an interactive robotic device having a body, a transport mechanism, a drive mechanism, a plurality of inputs and outputs for receiving, delivering and/or displaying information, including aural and/or visual information or signals, a container for carrying or holding items to be delivered or dispensed to a user, and a dispensing structure for dispensing items to a user.

13 Claims, 13 Drawing Sheets

Fig. 3
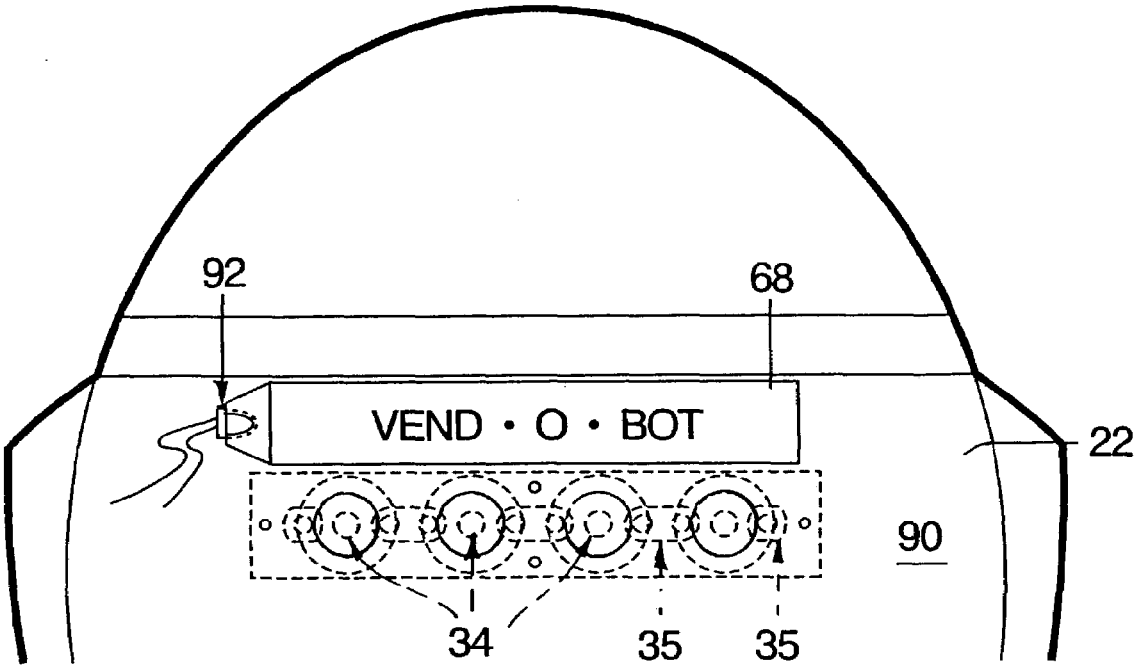
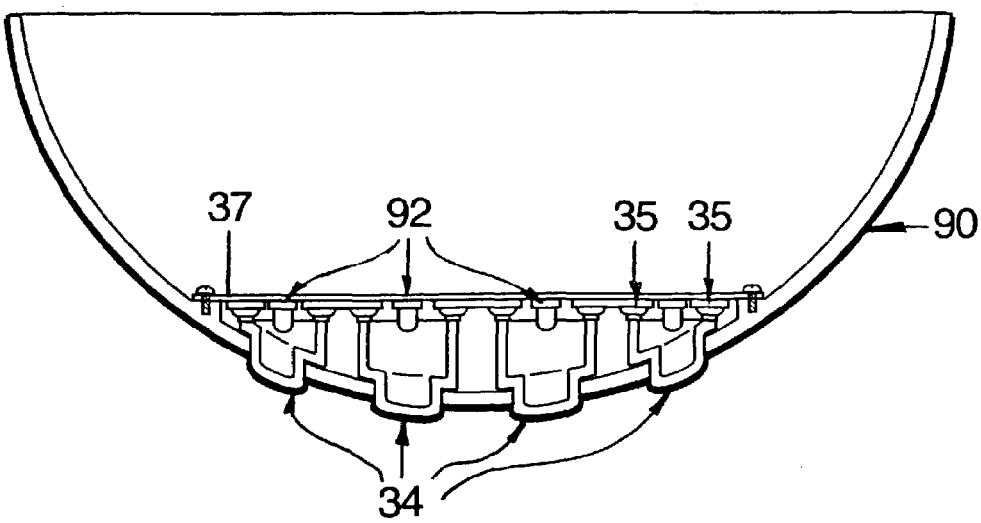
Fig. 4

Fig. 5
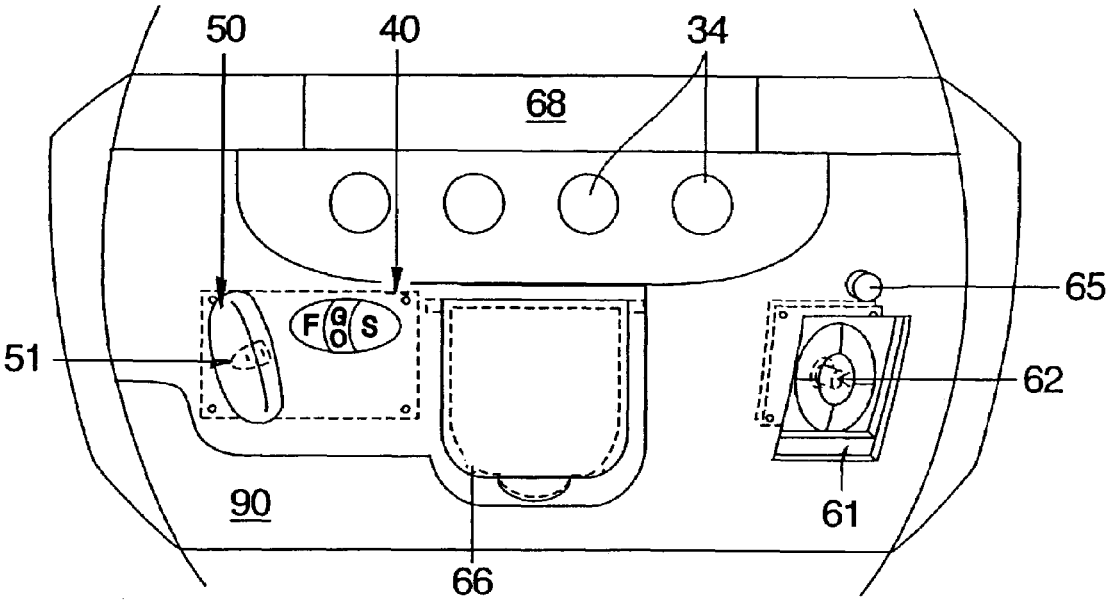
Fig. 6
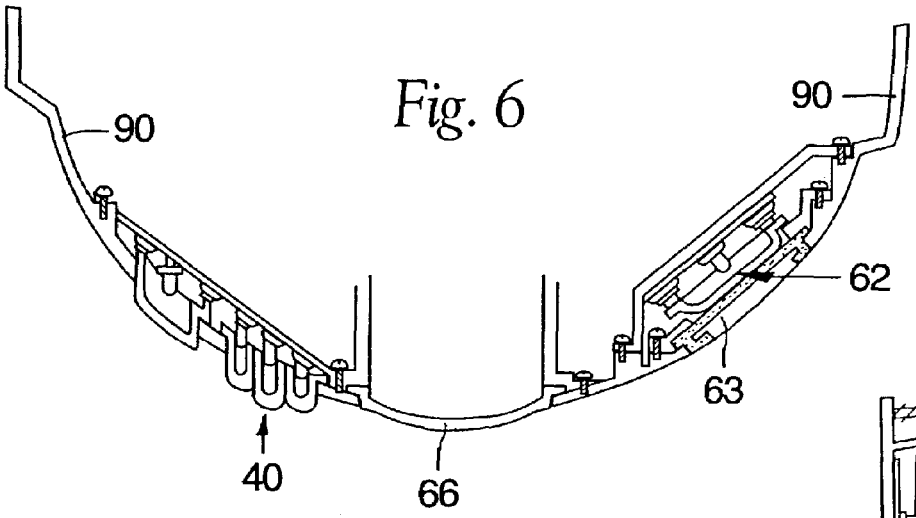
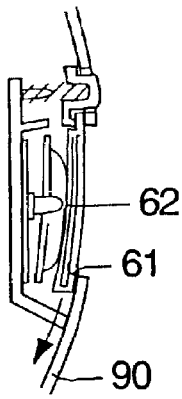
Fig. 6A

INTERACTIVE DISPENSING AMUSEMENT DEVICE

CROSS-REFERENCE TO RELATED APPLICATIONS

This application is a Continuation of U.S. application Ser. No. 09/777,143, filed Feb. 5, 2001, now abandoned, and claims the benefit of U.S. Provisional Application Ser. No. 60/180,360, filed Feb. 4, 2000, the contents of both of which are herein incorporated by reference in their entirety.

BACKGROUND

The present invention relates to toys and amusement devices and, in one embodiment, to an electro-mechanical interactive amusement device which performs selected, prompted or unprompted, activities, including the delivery or dispensing of an object.

Interactive devices are known in many arts, including the amusement device or toy art. For example, toy vehicles controlled by radio signals are well-known and typically comprise a vehicle that has an electric drive motor linked to a radio receiver that responds to radio signals from a hand-held controller/transmitter. In this way, a user can remotely move the vehicle backwards or forwards and steer it in any direction. Such toys typically do not dispense anything to the user.

Interactive dolls have ranged from a doll that closes its eyes when it is placed in a horizontal "sleeping" position to a computer-controlled interactive doll that receives commands from a personal computer via wireless transmissions. In use, typical interactive dolls act in a pre-determined fashion based on the stimulus provided by the user, and thus increase user enjoyment.

Generally, increased interactivity and visual and/or aural displays or actions provided by amusement devices increase the interest level for the user and, notwithstanding currently available interactive devices, there is a need in the art for an inexpensive, easy-to-use, interactive device that enhances user interest, involvement and enjoyment, particularly for children. Children are usually fascinated with toys that act or perform, so it would be advantageous if there were an interactive toy that acts or performs an activity upon receiving input or, apparently, on its own volition. The few available robotic toys are generally complicated, expensive, and require cumbersome headsets or waist-packs, so it would be advantageous if there were a simple, relatively inexpensive robotic device which would optimize a child's interest, for example, by providing visual and aural displays, and/or by performing an action or game, including delivering or dispensing an item to the child.

SUMMARY

In one embodiment, the present invention comprises an interactive robotic device.

In one embodiment, the present invention provides a "robotic" amusement device which is interactive with a user, and which dispenses an item, including dispensing an item in response to or as a result of a game played with or for a user. As used herein, the terms "robot" or "robotic" are intended to encompass mechanisms for performing tasks, including mechanisms guided or operated by controls, including automatic or internal controls, so that they may appear to function or operate of their own volition, and/or appear to be animated.

In one embodiment, the interactive robotic device of the present invention comprises a body or chassis, a transport mechanism, a drive mechanism and a plurality of inputs and outputs for receiving, delivering and/or displaying information, including aural and/or visual information or signals. It may further comprise one or more hoppers or container structures for holding items to be delivered or dispensed to a user, or to be carried for a user. The inputs may be wireless inputs or may be contact inputs such as touch-pad, key or switch devices. The invention may further comprise suitable hatches or cavities, removably covered or uncovered, for receiving, dispensing or delivering and/or carrying items, e.g., balls, secondary toys, etc. It may be programmable and/or reprogrammable to accomplish selected operations or functions, and may be operable in a variety of selectable modes.

In one embodiment, the present invention comprises an interactive robot which is interesting for people of all ages, particularly children. It comprises an intelligent robot with features including the ability to be programmed to move about, play games and dispense an item, for example, another toy or the like, for a user. In some embodiments, the present invention provides visual displays including light-up features, and audio or aural displays, including producing words and sounds, e.g., music, in one or more voices.

In some embodiments, the present invention is interactive in the sense that a user may play a game, such as a riddle game, with the present invention and, upon winning the game or a portion thereof, the present invention dispenses an object, e.g., a prize, to the person playing with it.

In some embodiments, the present invention includes one or more hidden or secret compartments on its body wherein objects, such as trading cards, may be hidden.

In some embodiments, the robotic interactive amusement device of the present invention is controlled by a user through the user providing inputs, whereby a user may select a game to play or an action for the robot to perform. In some embodiments, the robotic amusement device of the present invention may be programmed to dispense an object upon a request from a user. The request may be provided to the amusement device by touching an appropriate location on the device or by an aural or wireless request.

In some embodiments, the present invention can take instruction or input from a user and be directed to deliver and dispense a toy to friends of the user. Additionally the amusement device can be programmed to perform selected movements such as moving forward or spinning around.

In one embodiment, the robotic amusement device of the present invention comprises a two way switch for actuating the amusement device, and/or a key which may also be used to turn the amusement device on and off.

In some embodiments, the present invention includes a 60 sec IC chip. The chip, or the like, may randomly select sounds for the device to produce, and may actuate lights and/or displays when the device is turned on. In some embodiments, the present invention may include a plurality of LED's and/or other light sources which are programmed to flash inside the device, for example, in the dome portion.

In some embodiments, the amusement device of the present invention may be programmed to play one of a selected number of games upon command. One game may be known as "Spin-the-Bot" wherein a group of children may gather in a circle and, upon command, the robot will spin in the center of the circle and give a prize when it stops spinning. A second game may be known as "Guess It"

wherein a user may choose a correct light or other display out of such displays provided on the device and receive a prize. A third game may be known as "Follow Me" and comprises a user following a pattern of lights actuated by the microprocessor. Yet another game may be known as "Stop Light" wherein the user may push a selected input where the user guesses that the light display will stop.

In some embodiments, the device of the present invention has three movement buttons or inputs, forward, spin and go. The device may be programmed by a user by pushing selected inputs for a period of activity for each input. Once programmed, the device may be actuated by, for example, pushing a go or start button or input. For example, if the forward button is pushed four times and then the go button is actuated, the device will move forward for eight seconds and stop until further programmed.

In some embodiments, the amusement device of the present invention will dispense a toy or other object upon command by actuating a "dispense" button or input on the robot device. In some embodiments, toys may be dispensed from the "belly" of the robot. In some embodiments, the dispensing may occur as part of a game or activity performed by the robot, apparently without input from a user. For example, the dispensing may occur automatically as a game result or an activity outcome or conclusion.

In some embodiments, the dispensing feature of the present invention further comprises a selected number of items to be dispensed, for example, plastic balls or marble or egg shaped items, each of which may contain a toy or prize. The balls may be reused again and again and, in some embodiments, may be colored or opaque.

In some embodiments, the amusement device of the present invention may have one or more additional compartments, one or more of which may be secret or invisible until a compartment cover is actuated either by a user or, apparently, by the device itself. The secret compartment(s) may be adapted to hold a number of objects, including, for example, trading cards.

In one embodiment, the amusement device of the present invention includes a clear, upper dome-like portion that displays the items that the device will dispense. In some embodiments, when the dome is opened, the amusement device automatically turns off. In some embodiments, the present invention may be provided with an agitator whereby, as the device moves, the agitator agitates the items to be dispensed to give a "popping" effect, and/or to provide for their jam-free delivery.

In some embodiments, the amusement device of the present invention may be provided with one or more motors, for example, electronic stepper motors. Motors may be provided to separately actuate portions of the amusement device, for example, one motor may be provided to actuate the agitator and another the transport mechanism.

The present invention may comprise a sound system including a speaker for producing sounds upon selected inputs from a user. The sound system may include sound sensing devices, such as a microphone, to sense or receive input from a user or the environment. In some embodiments, the present invention may provide a random play back of selected sounds.

Additional features and advantages of the present invention will become apparent with reference to the accompanying Figures, the following description and the appended claims.

BRIEF DESCRIPTION OF THE FIGURES

FIG. 3 depicts one embodiment of an input system for the present invention.

FIG. 4 is a sectional view of the input system of FIG. 3.

FIG. 5 depicts a portion of the front of the embodiment of FIG. 2.

FIG. 6 is a sectional view of the portion depicted in FIG. 5, and FIG. 6*a* depicts additional detail of a portion of the present invention.

FIG. 15, including

DESCRIPTION

Figure 1:
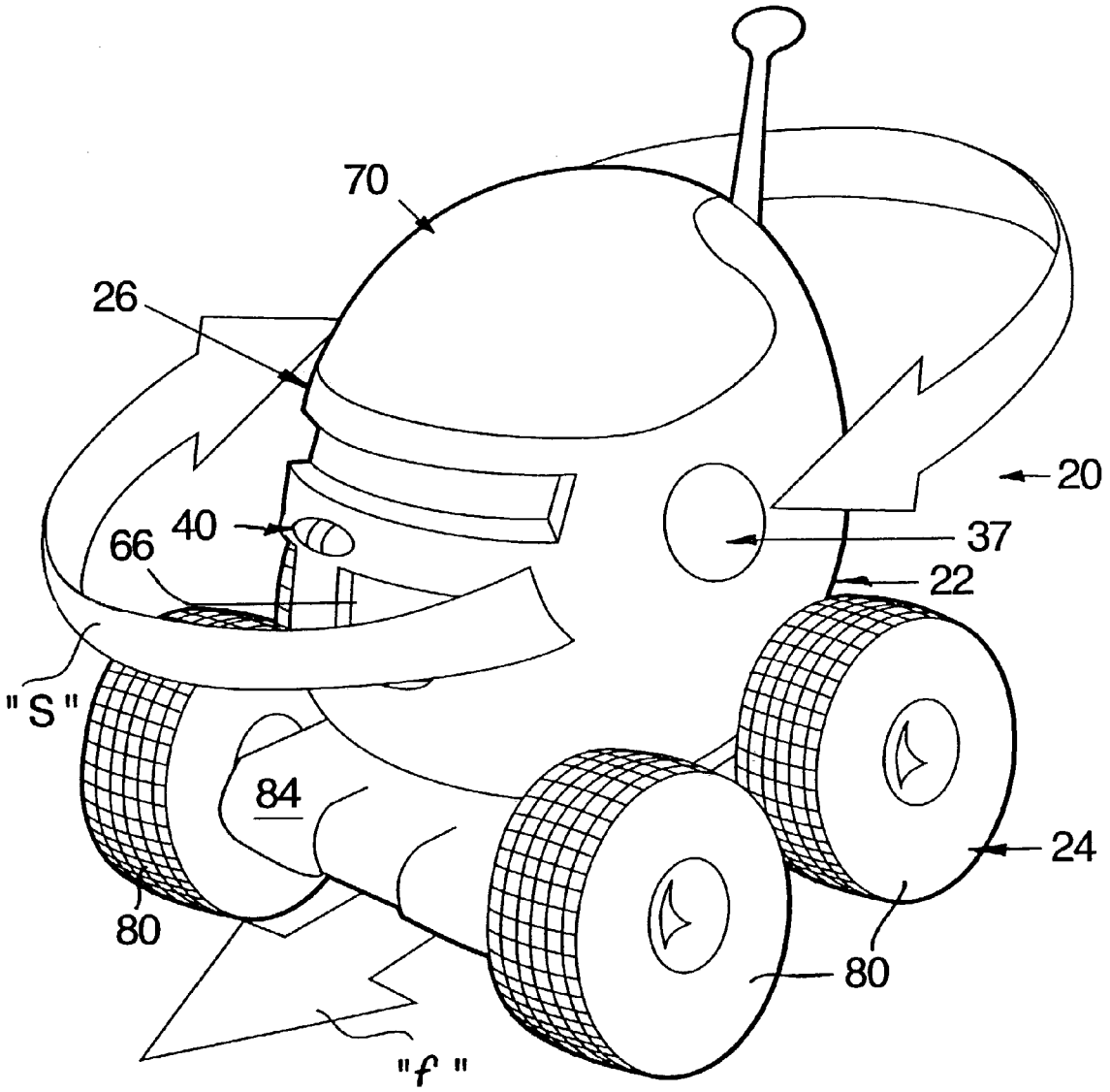
FIG. 1 depicts one embodiment of the present invention.

Features and advantages of the amusement device apparatus and method of the present invention will become more fully apparent and understood with reference to the above-referenced drawings and this description, including the described embodiments of an interactive robotic amusement device (which also may be referred to as a toy), and the description of the method or process by which the device functions and/or interacts with a user, and the features and method which provide a dispensing function.

The accompanying Figures and this description depict and describe embodiments of the amusement device of the present invention, and features and components thereof. With regard to fastening, mounting, attaching or connecting the components of the present invention to form the apparatus as a whole, unless specifically described otherwise, the invention may incorporate or use conventional fasteners such as screws, nut and bolt connectors, machined connectors, snap rings, clamps such as screw clamps and the like, rivets, toggles, pins and the like. Components may also be connected by snap fitting, adhesives, sewing, welding, friction fitting or deformation, if appropriate. Electrical features and functions may be accomplished by using any suitable electrical devices, including, but not limited to, printed circuits, pc boards, chips and the like, light sources, switches, speakers, power sources, sensors and inputs and outputs. Electrical connections may be made using appropriate electrical components and connection methods, including available components, connectors and connecting methods. Unless specifically otherwise disclosed or taught, materials for making components of the present invention are selected from appropriate materials such as metal, metallic alloys, plastics and the like, and appropriate manufacturing or production methods including casting, extruding, molding and machining may be used.

Any references to front and back, right and left, top and bottom and upper and lower are intended for convenience of description, not to limit the present invention or its components to any one positional or special orientation.

A microprocessor or controller, or microprocessors, for the present invention can be any integrated circuit, digital controller or microprocessor-based system, and more than one may be involved. In one embodiment of the invention, the controller comprises a suitable processing unit and suitable peripheral devices. A suitable peripheral device may be a field programmable micro-controller peripheral device that includes programmable logic devices, EPROMs, and input-output ports. Typically, instructions are stored in the controller as program logic, which might be found as RAM or ROM hardware in the peripheral device. (Since the processing unit may have some memory capacity, it is possible that some of the instructions are stored in the processing unit.) As one skilled in the art will recognize, various implementations of program logic are possible. The program logic could be either hardware, software, or a combination of both. Hardware implementations might involve hardwired controller logic or instructions stored in a ROM or RAM device. Software implementations would involve instructions stored on a magnetic, optical, or other media that can be accessed by the processing unit. Communication implementations may be wired, optical or wireless.

Referring to the Figures, particularly FIG. 1, in one embodiment, the robotic amusement device 20 of the present invention comprises a body 22 carried on a transport mechanism 24. The upper region 26 of the body houses a dispensing mechanism, described in more detail below with reference to FIGS. 10 and 11.

Figure 2:
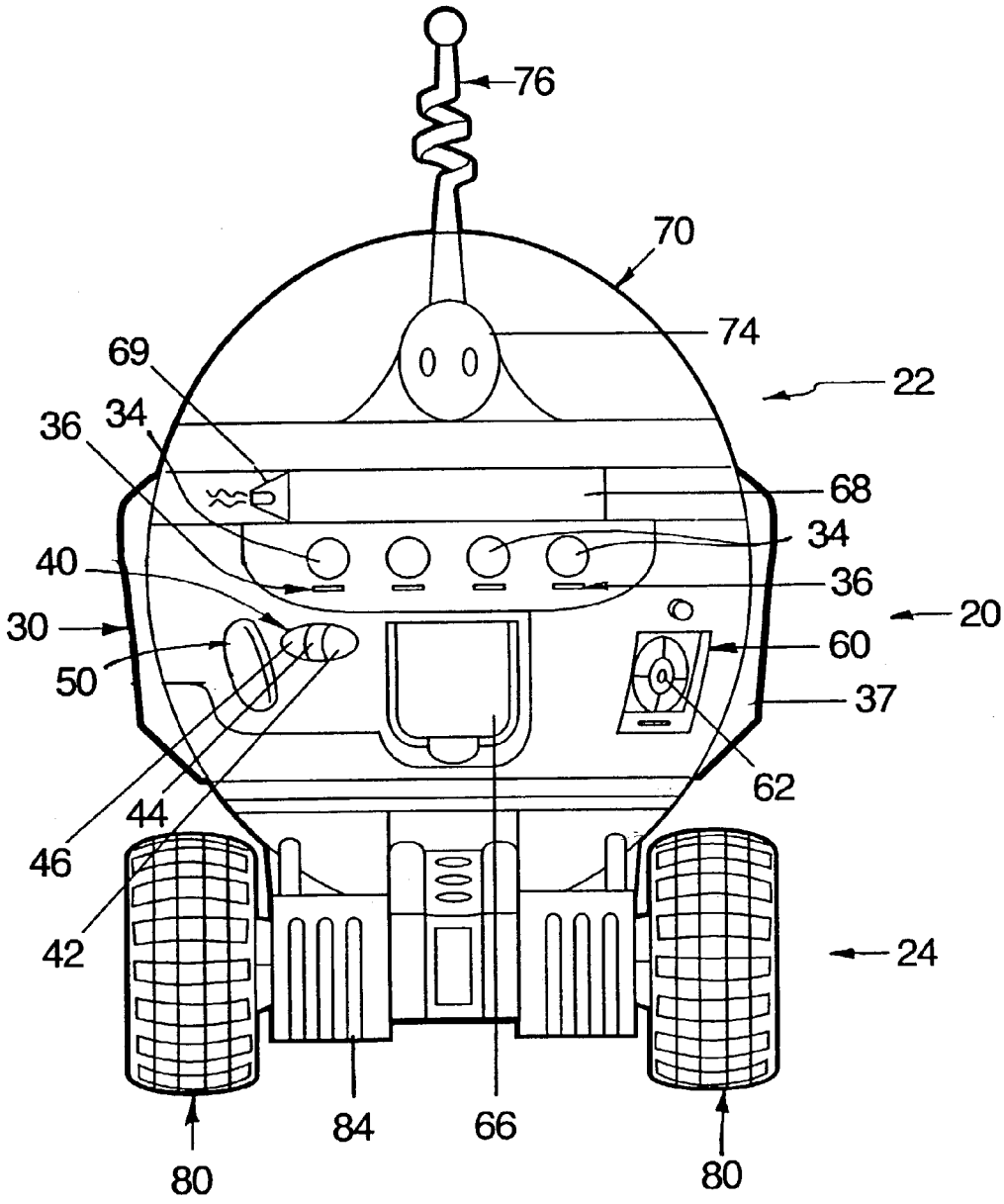
FIG. 2 depicts the front of one embodiment of the present invention.

Referring to FIG. 2, the body 22 includes a front side carrying a plurality of inputs 30. In one embodiment, the inputs include at least four input buttons 34 which may be pushed or touched to select an operational mode or a game. Each button 34 may be used to select one or more games, or game steps or performances, and a button title or command indicator 36 may be positioned near the button. The body 22 also carries a actuation button 40 which may be split into at least three portions including a spin portion 42, a go portion 44 and a forward portion 46. Further operational controls of the present invention are provided by a game mode button 50. Any of the inputs 30 may be lighted by a suitable internal light source. The body may be provided with punch-out regions, built-up areas or weakened sections, e.g., indicated in phantom at 37, to accommodate future modifications, for example, the attachment of appendages or additional displays.

Another feature of the present invention is a secret panel or compartment 60 which houses a toy providing button 62. Additional details are depicted in FIGS. 6 and 6*a*. The body 22 is provided with a dispensing hatch 66 and a lighted display portion 68, with illumination provided by one or more suitable sources, such as LED's 69. The upper portion 26 the amusement device 20 includes a dome 70 which may be clear, partially clear or opaque, and which may be lighted by an LED display 74. The device 20 carries an antenna 76 which may be adapted to receive commands or signals. In some embodiments, any number of input buttons and lights may be provided on or in the device.

Figure 12:
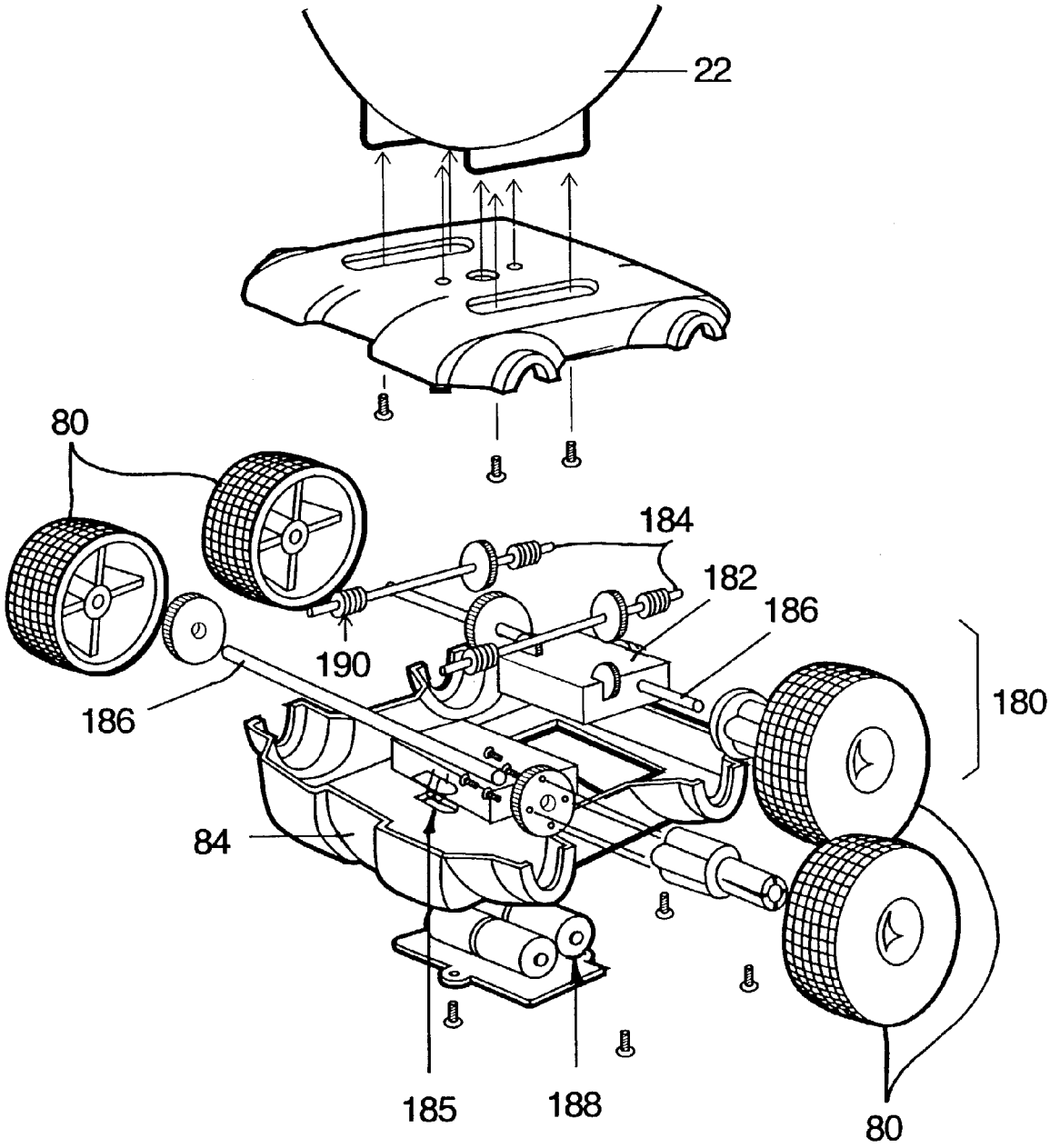
FIG. 12 is an exploded view of one embodiment of a transport mechanism for the present invention.
Figure 13:
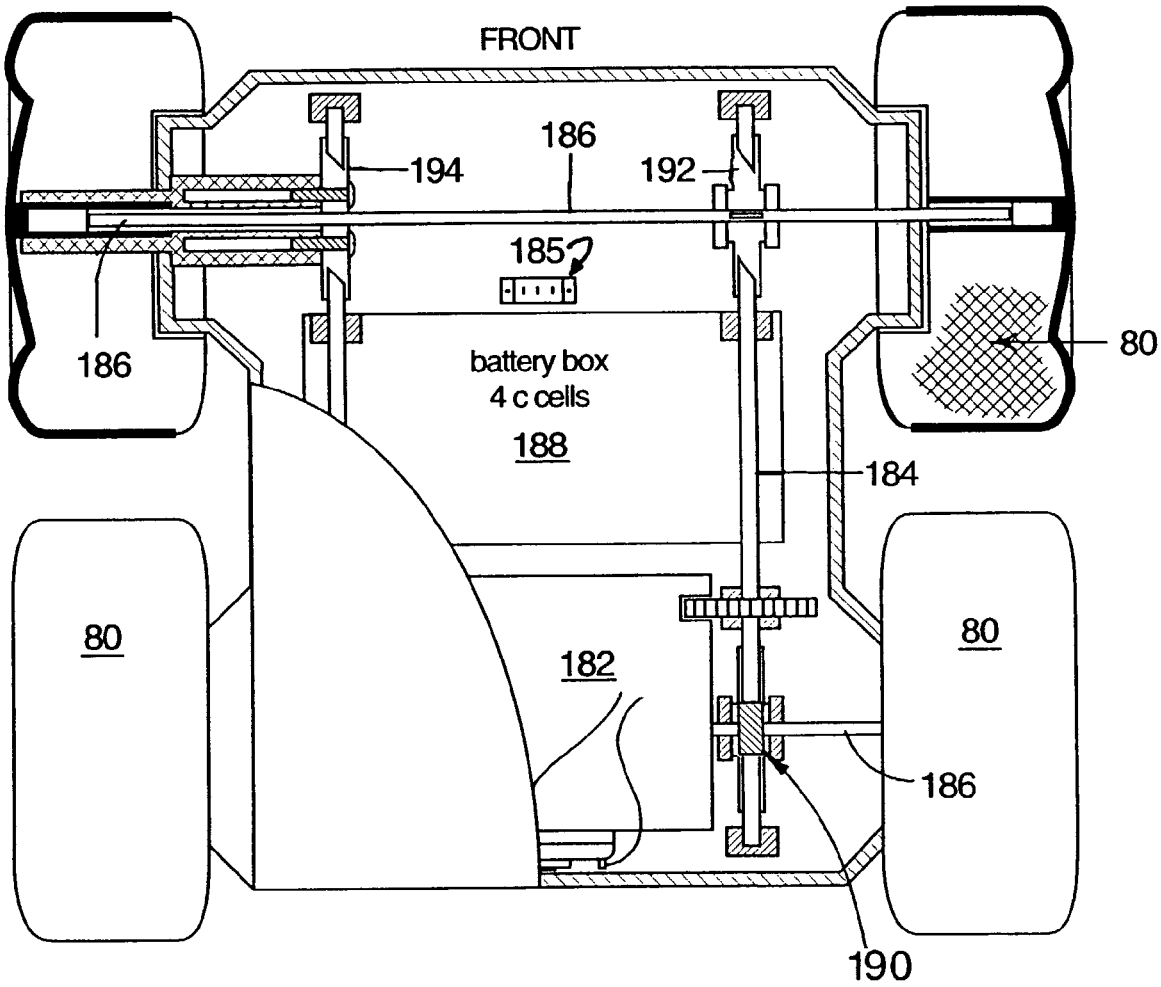
FIG. 13 depicts the transport mechanism of FIG. 12, partially in section.

With continued reference to FIG. 2, the transport mechanism 24 includes four wheels 80 mounted on a chassis 84. In some embodiments, the wheels could be replaced by crawler-type "tracks," one on each side of the robot 20. The chassis 84 houses the drive or transport mechanism for the present invention, including one or more motors, batteries, appropriate switches (see FIGS. 12–13). As will be explained more fully below, the drive or transport mechanism enables the robot 20 of the present invention to perform selected movements, including forward and spinning movements, e.g., see arrows "f" and "s" of FIG. 1.

Referring to FIGS. 3 and 4, additional detail with respect to the operation buttons 34 is depicted, particularly the mounting of the buttons 34 using a rubber contact push button structure 35 attached to a mounting flange 37 attached to the front wall 90 of the body. FIG. 3 also depicts that the device 20 may have transparent or semi-transparent display portions, for example display 68, which may be lighted by one or more suitable light sources such as LED's 92.

FIG. 4 is a sectional view depicting one way of providing the illumination of the game buttons or inputs 34, wherein each game button 34 is backed by a suitable light source such as an LED 92.

FIGS. 5, 6 and 6*a* depicts additional details with respect to the features of the present invention. FIG. 5 depicts that the game mode switch 40 and the game mode buttons 50 may be lighted by a suitable light source such as an LED 51. Similarly, the dispensing button 62 or other features may also be lighted.

FIG. 6 is a top plan view sectional view depicting the positioning and mounting of the game mode and dispensing buttons 50, 62 on the inside of the body wall 90. It also shows the secret panel 61 covering the toy dispensing button 62, the toy dispensing button 62 and how these features may be mounted to the skin or wall 90 of the body 22. Note that the secret panel 61 includes an outermost C-channel 63 for receiving a removable cover (not shown) at its initial use or when the secret panel 61 is in its down position (see FIG. 6*a*). A panel actuation button 65 may be provided.

Figure 7:
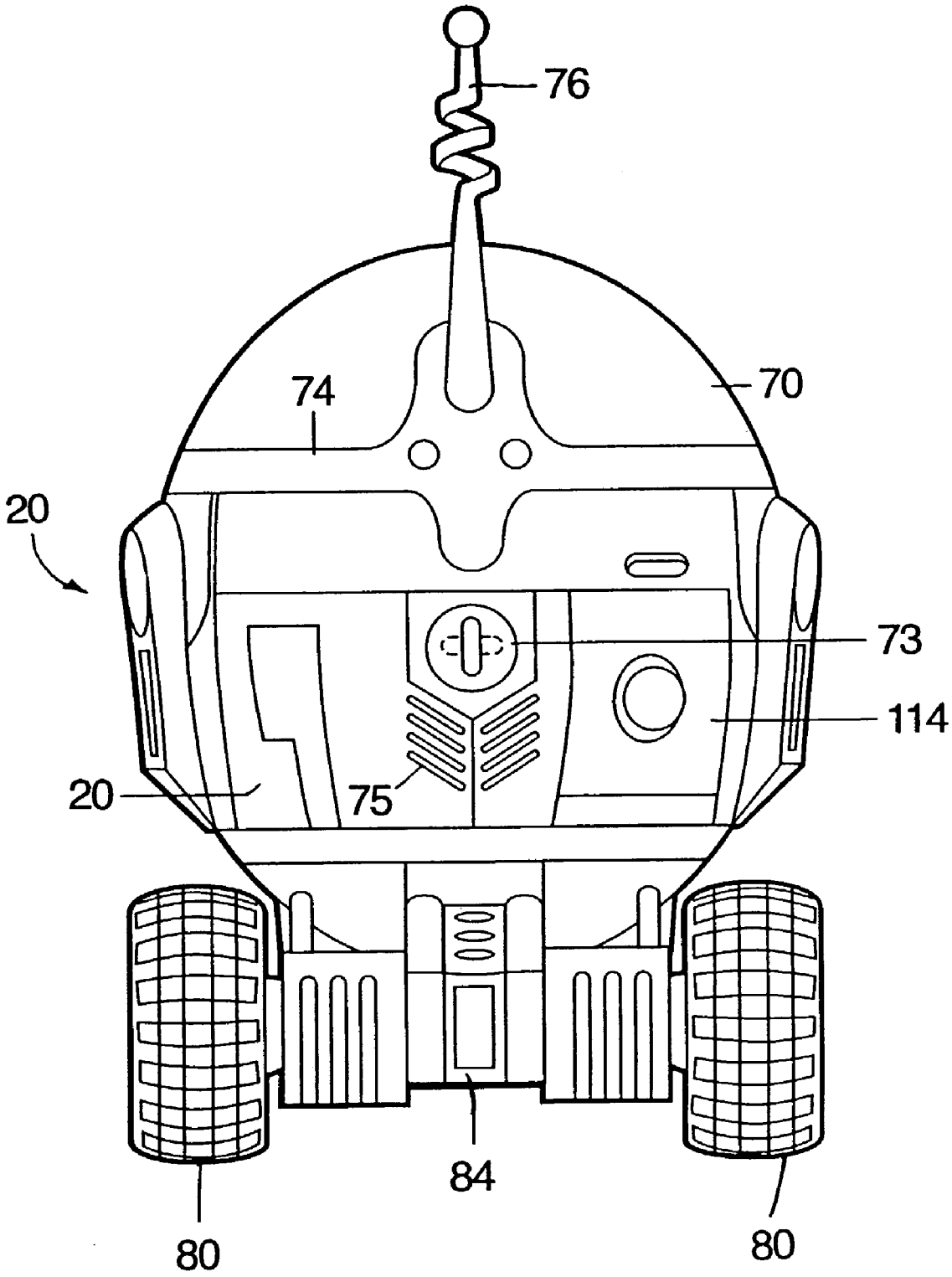
FIG. 7 depicts the rear of one embodiment of the present invention.
Figure 8:
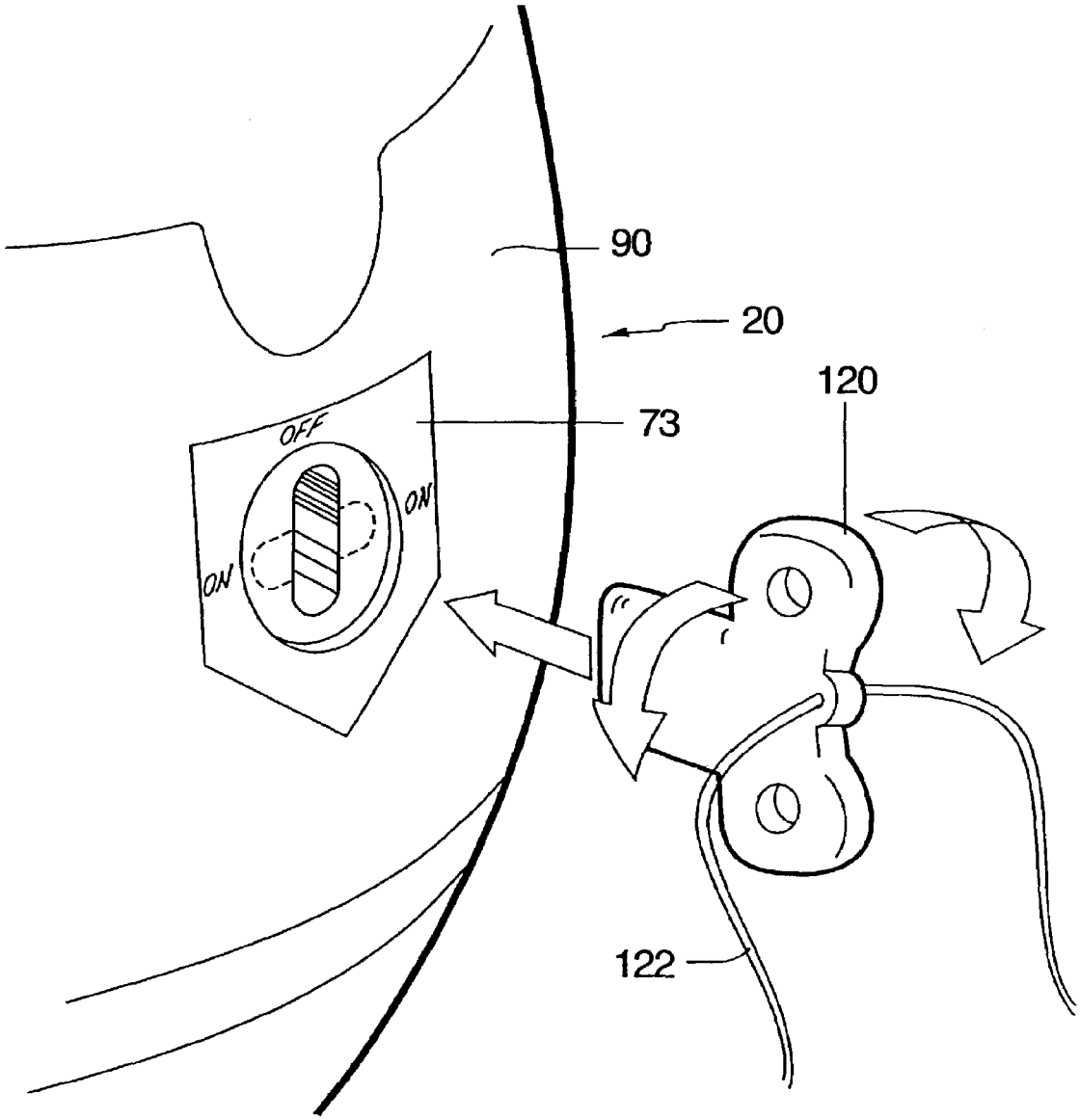
FIG. 8 depicts one embodiment of a key for use with the present invention.

FIG. 7 depicts the rear or back of the present invention, particularly a lock 73 suitable for use to control the invention. Referring further to FIG. 7, the body 22 of the present invention is provided with speaker vents 75 and an additional compartment 114, also shown in FIGS. 9 and 9*a*. Referring to FIG. 8, the present invention 20 may be accompanied by a key 120 which is received in the lock 73. The key 120 may be carried on a suitable necklace 122. In some embodiments, turning the key 120 left or right acts to switch on or activate the robot 20, and the key 120 may be turned back to a vertical off position. Note that if the key 120 is lost any standard screw driver or coin will work to operate the lock 73.

Figure 9A:
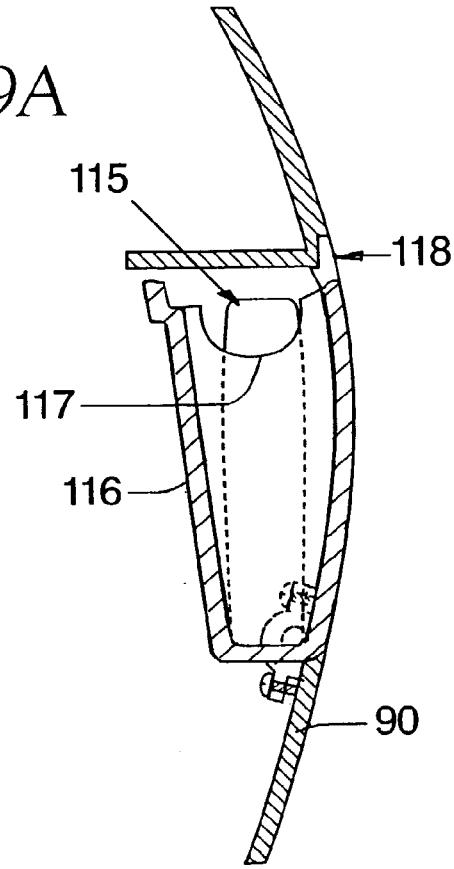
FIG. 9*a*, depicts one embodiment of a compartment provided by the present invention.
Figure 9:
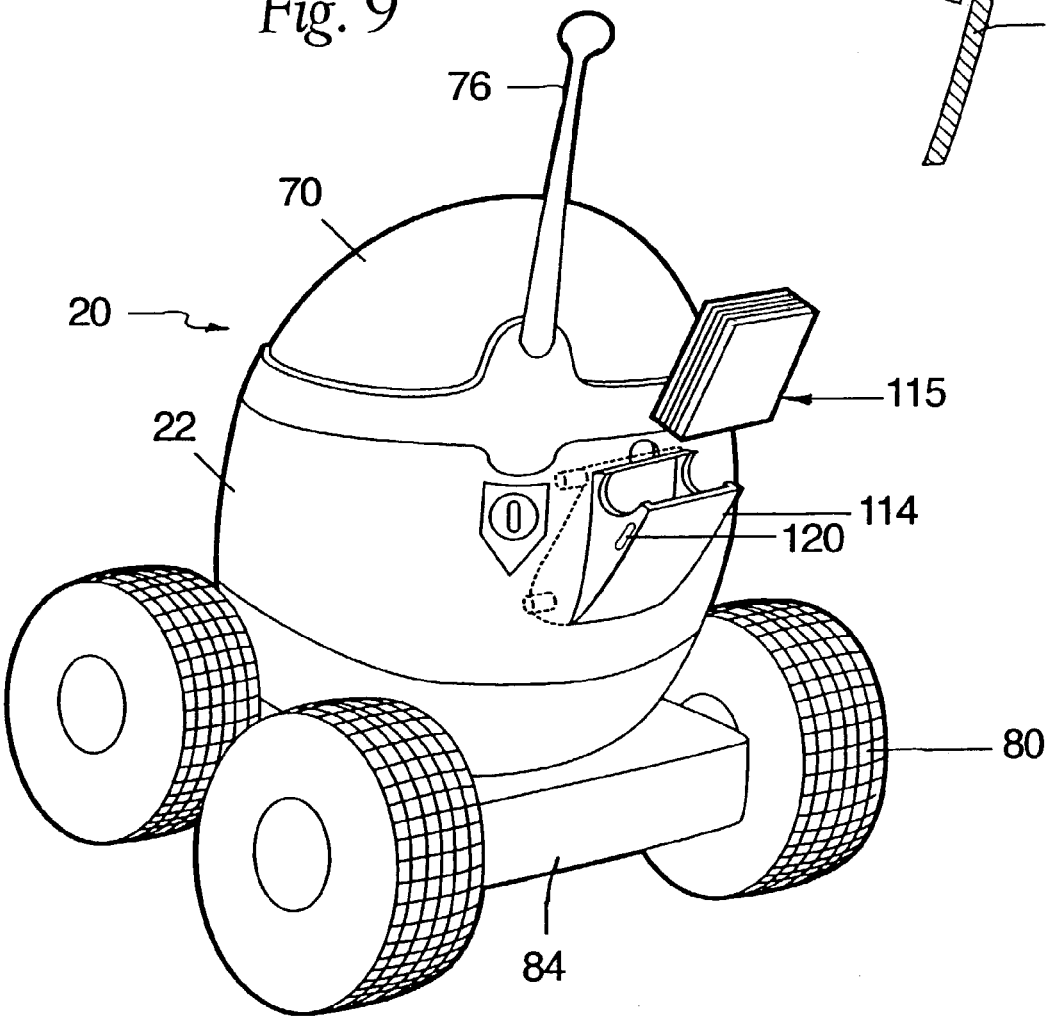
FIG. 9, including

Referring to FIG. 9, and FIG. 9*a*, the body 22 of the present invention may be provided with one or more secret compartments 114. FIG. 9*a* shows additional detail with respect to a secret compartment 114 and how it may be mounted to the wall 90 of the body 22 of the present invention. As shown in FIGS. 9 and 9*a*, the compartment 114 may be adapted to hold a set of playing or trading cards 115, but may be adapted to contain any selected object. In one embodiment, the secret compartment 114 provides a drawer structure 116 including notched sides 117 for easy extraction of the contents, and a finger receiving slot 118 may be provided for a finger pull feature at the upper edge. Additionally, the compartment 114 may be provided with a snap bump 120 to hold the compartment 114 closed.

Figure 10:
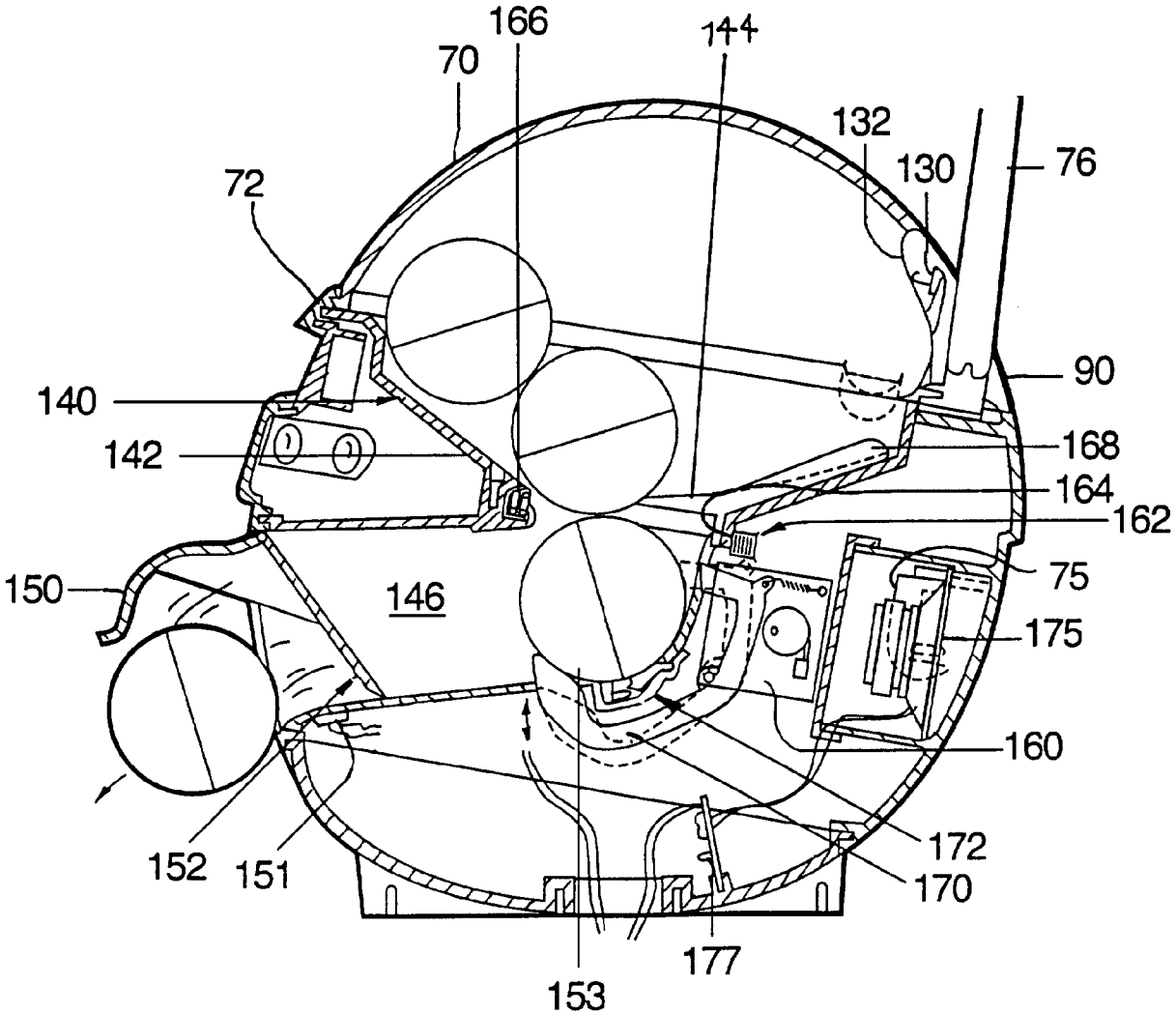
FIG. 10 depicts one embodiment of a dispensing system for use in the present invention.
Figure 11:
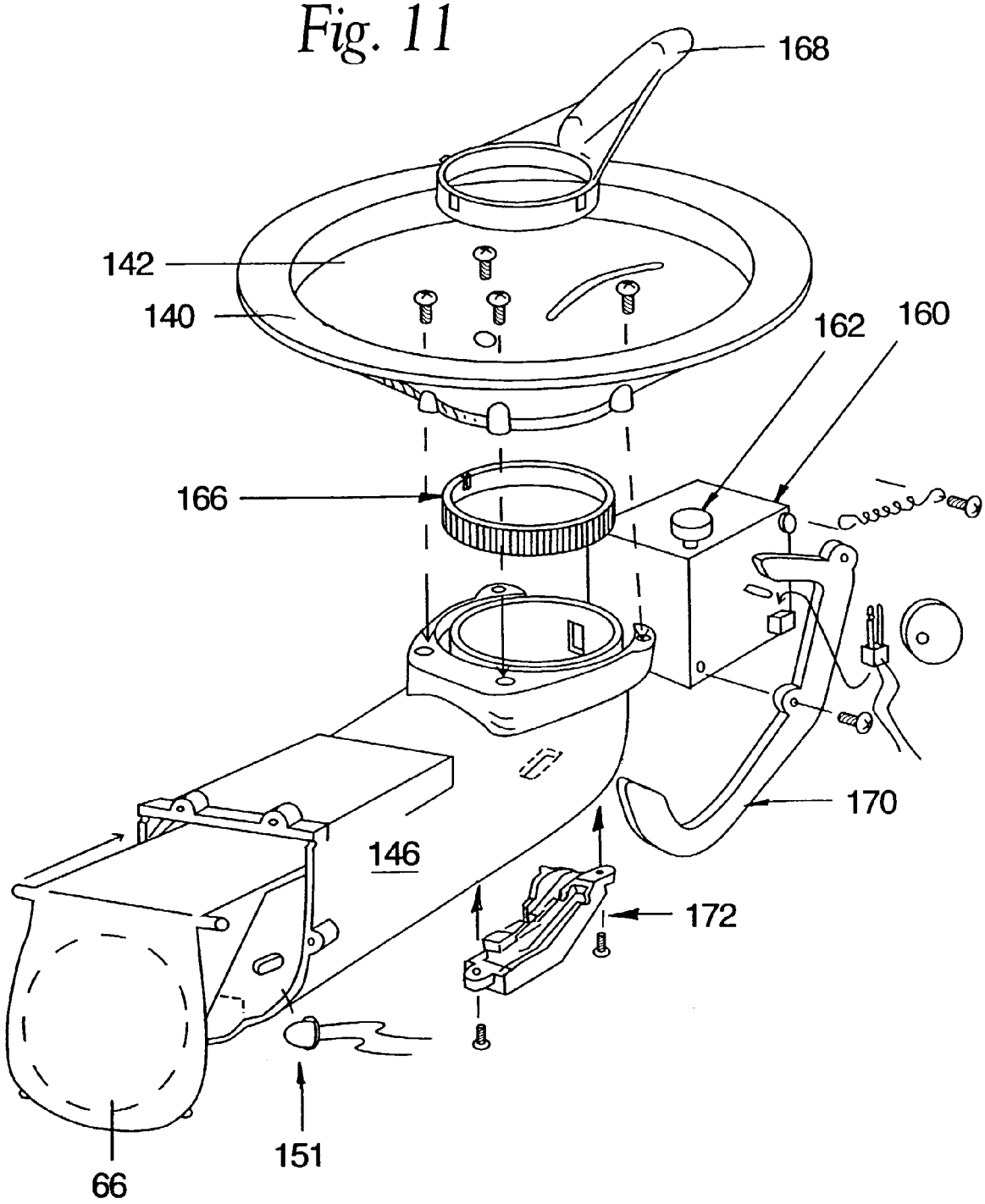
FIG. 11 is an exploded view of the system of FIG. 10.

Referring to FIGS. 10 and 11, additional detail with respect to the dispensing mechanism or feature of the present invention is depicted. The dispensing feature is located generally at the upper region 26 of the present invention 20 and includes the dome 70. The dome 70 is removable and is provided with a dome catch 72 which may take the form of any suitable friction fit, bayonet or screw threaded-type structure. Near the dome, the antenna 76 in the upper region of the invention is provided with a light source such as LED's 130 covered by a lens 132 for illuminating the interior of the dome 70. The upper region of the body further includes a hopper 140 generally under the dome. The hopper 140 is formed by a suitable, generally conical wall structure 142. At its lowermost point, the hopper 140 includes a generally central circular opening 144. The wall 142 forming the hopper 140 may be secured to the outer skin 90 of the body 22. The wall 142 is continued to form a generally tubular passage or chute 146 closed by a suitable door 150. The door may be lighted by a suitable light source, such as an LED 151. An interior stop wall 152 may be provided to prevent the user from putting a hand or finger into the chute 146. The chute 146 opens to the exterior of the device 20 and is closed by the door 150.

Dispensing is actuated by a motor and gear box arrangement 160 mounted suitably inside the body 22 of the robot 20. An agitator drive gear 162 extends from the motor and gear box 160 and is operably coupled to the peripheral edge 164 of the hopper 140, particularly to an agitator gear 166 which is welded or otherwise attached to an agitator arm 168. Actuation of the motor 160 causes the arm 168 to rotate, or sweep or move, around the base of the hopper 140.

The dispensing assembly further includes a spring loaded ball stop arm 170 pivotally coupled to the gear box 160. The ball stop arm 170 is operably coupled to a ball sensor and leaf switch 172 for actuation whereby, when a ball 153 is present and upon a dispense command, the arm 170 moves from a ball holding position shown in FIG. 10 to a ball release position, also shown in FIG. 10, in phantom. FIG. 10 also shows one location for a speaker 175 and a circuit board controller 177. The controller 177 may control all operations of the robot 20 or may be dedicated to dispensing operations, in which case additional suitable controllers may be provided for other functions. FIG. 11 is an exploded view of the dispensing system, depicting the interconnection of the components thereof.

FIGS. 12–15 depict the transport or drive mechanism 180 of the present invention. The drive mechanism 180 is operably coupled to the body 22 of the present invention and is housed in the chassis 84. It comprises a drive motor gear box assembly 182 coupled to a suitable off and on switch 185. The motor gear box 182 is coupled to two drive shafts 184, one for each set of wheels 80 which are mounted on opposite sides of the chassis 84 on axles 186 extending transversely across the chassis 84. The chassis 84 also provides for housing batteries 188, typically four C-cells. The gear box assembly 182 includes a suitable motor, and the drive shafts 184 carry suitable worm gears 190, one for each wheel, for driving the four wheels 80. The axles 186 spin freely within the chassis 84. In one embodiment, the present invention is provided with a right drive gear and a left drive gear 192, 194. Other suitable drive/power arrangements could be used, for example, each wheel could be driven directly by a respective motor.

Figure 14A:
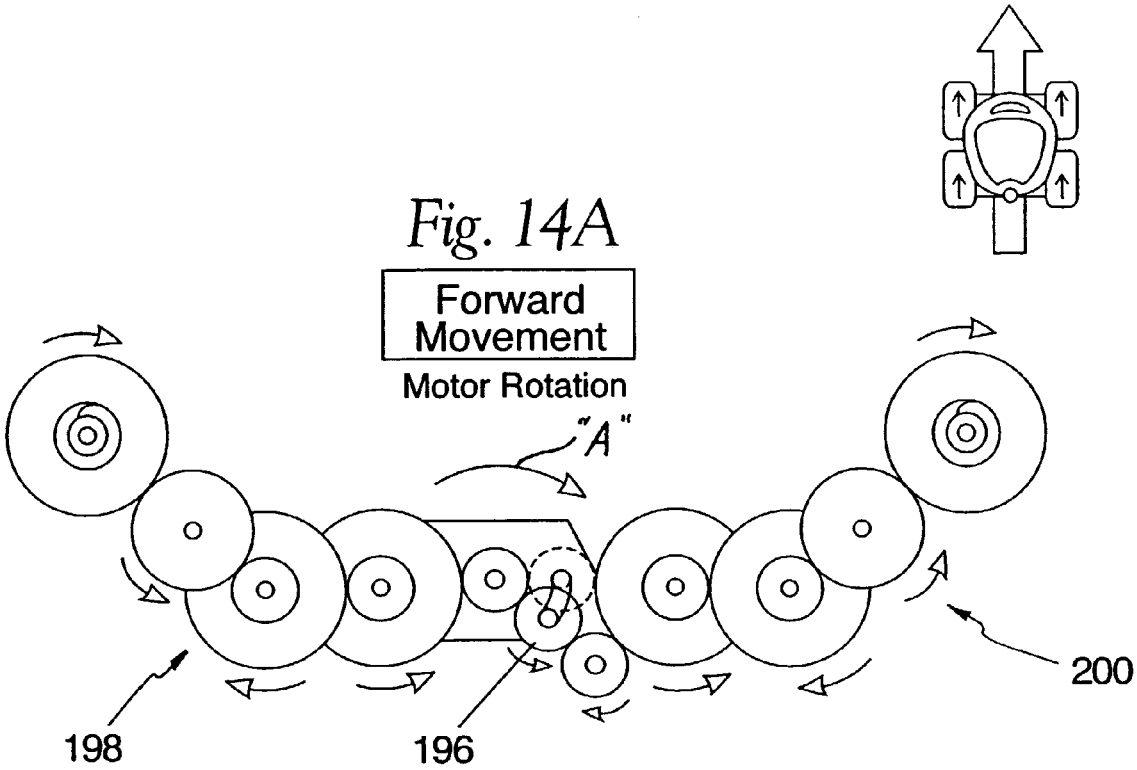
FIG. 14 depicts one embodiment of a drive linkage and its operation.
Figure 14B:
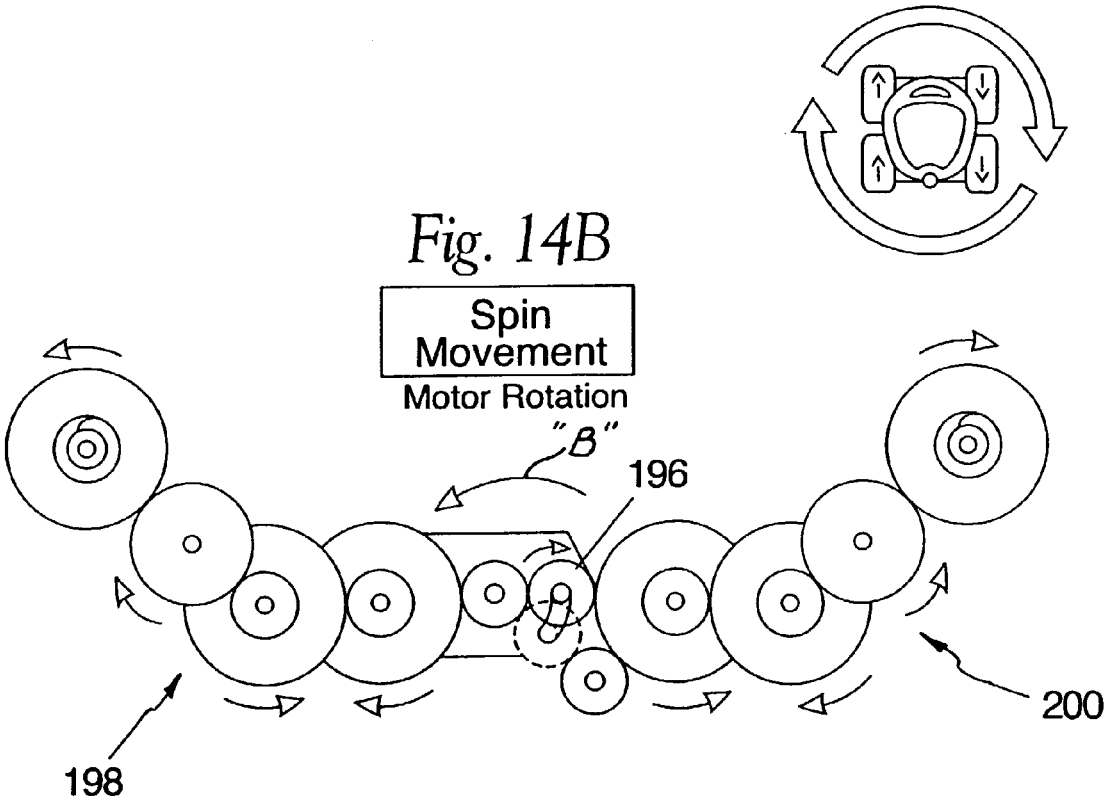

Referring to FIG. 14, a "kick-out" gear train arrangement, including a positionable kick-out gear 196, is represented, along with two gear trains 198, 200, and forward and spinning movements. Upon command, the direction of motor rotation determines the movement performed. Upon motor rotation in direction "A," as depicted in FIG. 14, gear 196 achieves a first position thereby causing movement of both gear trains 198, 200 in the same direction, rotation of all wheels 80 in one direction and forward motion of the robot 20. FIG. 14 also depicts a second reverse motor rotation "B" wherein gear 196 is kicked to a second position causing one gear train 198 to move in the opposite direction of the other 200. This provides for a spinning movement. The motor output may be controlled by a suitable microprocessor and by commands from a user, including, for example wireless commands.

Figure 15A:
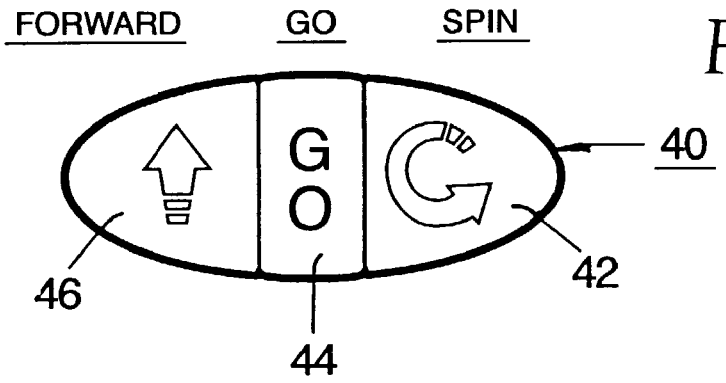
FIGS. 15A, 15B and 15C depict one embodiment of functions or operations of the present invention.
Figure 15B:
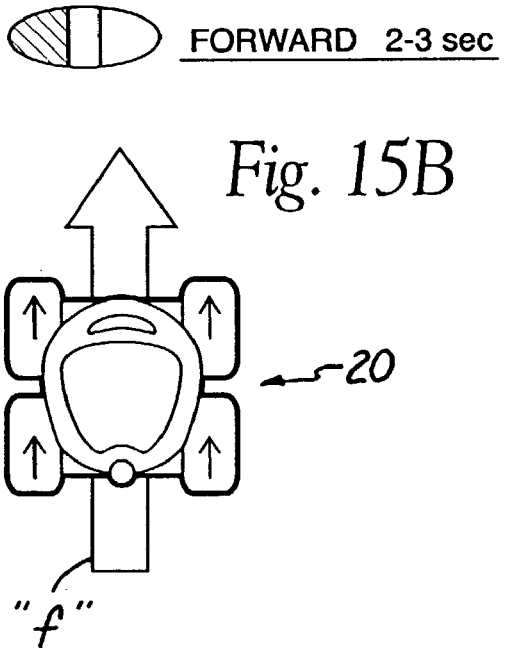
Figure 15C:
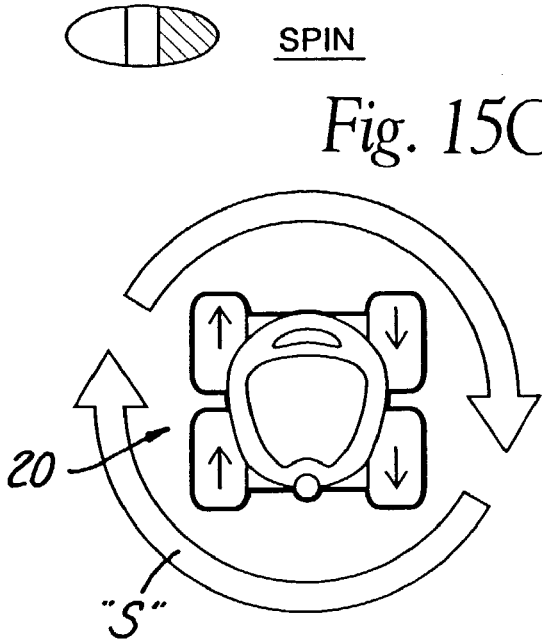

FIG. 15, including FIGS. 15*a*–*c*, depicts embodiments of the operation of robot 20 using the control button 40, which may be provided with indicator symbols as shown. The robot 20 of the present invention can be programmed to perform up to four movements in sequence by using the button 40. Any combination of forward and spin input commands, followed by pressing go, puts the present invention 20 into motion. In some embodiments, there may be a delay with certain sound effects before a motion begins. In one embodiment, each press of the forward portion of the button 40 or the spin portion of the button 40 causes two seconds of movement. In other words, in one example, a user might sequentially push the forward portion, the spin portion, the forward portion, then the spin portion, then push the go portion. This would result in a forward motion (FIG. 15*b*) of two to three seconds and then immediately a spin movement (FIG. 15*c*) for two to three seconds, thereby providing, for example, a 450° spin, i.e., one and one-quarter turns, followed again by a forward motion. In this fashion, the robot 20 may be programmed by a user to perform as desired.

The present invention may be embodied in other specific forms without departing from the essential spirit or attributes thereof. It is desired that the described and depicted embodiments be considered in all respects as illustrative, not restrictive.

What is claimed is:

1. A self-propelled robotic device comprising:

a body;

a transport mechanism operably coupled with the body, the transport mechanism adapted to propel the robotic device;

a drive mechanism operably coupled with the transport mechanism, the drive mechanism adapted to operate the transport mechanism;

said transport mechanism including a chasis and wheels mounted on said chasis to propel said robotic device to move forward and to spin around, said transporting device includes a kick out gear arrangement comprising a position able kick out gear having two gear trains with forward and spinning movements wherein said drive mechanism includes a motor gear box wherein direction of motor rotation determines a movement performed so that motor rotation in one direction causes movement of both gear trains in a same direction, rotation of all wheels in one direction and forward movement of said robot and a reverse motor direction causes one gear train to move in an opposite direction of another of said two gear trains to provide a spinning movement for said robot;

an input component associated with the body, the input component adapted to be actuated to activate the device to perform an action;

an output component associated with the body, the output component adapted to output one of either light or sound;

a container component operably coupled with the body, the container adapted to releasably carry at least one item; and a dispensing component operably coupled with the container, the dispensing component comprising a hatch adapted to dispense the at least one item gravitationally.

2. The self-propelled robotic device of claim 1, wherein the output component is adapted to output aural information.

3. The self-propelled robotic device of claim 1, wherein the output component is adapted to output visual information.

4. The self-propelled robotic device of claim 1, further comprising a microprocessor associated with the input component, the microprocessor adapted to perform the action upon actuation of the input component.

5. The self-propelled robotic device of claim 4, wherein the input component comprises a wireless input component.

6. The self-propelled robotic device of claim 4, wherein the input component comprises a contact input component.

7. The self-propelled robotic device of claim 1, wherein the output component is adapted to actuate the dispensing component to dispense the at least one item upon actuation of the output component.

8. The self-propelled robotic device of claim 1, further comprising a compartment component associated with the body, the compartment component adapted to removably carry an object.

9. An interactive robotic device comprising:

a body;

a transport mechanism associated with the body, the transport mechanism adapted to propel the robotic device;

a drive mechanism operably coupled to the transport mechanism, the drive mechanism adapted to operate the transport mechanism;

said transport mechanism including a chasis and wheels mounted on said chasis to propel said robotic device to move forward and to spin around, said transporting device includes a kick out gear arrangement comprising a position able kick out gear having two gear trains with forward and spinning movements wherein said drive mechanism includes a motor gear box wherein direction of motor rotation determines a movement performed so that motor rotation in one direction causes movement of both gear trains in a same direction rotation of all wheels in one direction and forward movement of said robot and a reverse motor direction causes one gear train to move in an opposite direction of another of said two gear trains to provide a spinning movement for said robot;

an input component associated with the body, the input component adapted to be actuated to activate the device to perform an action;

an output component associated with the body, the output component adapted to output one of either light or sound;

a container component associated with the body, the container component comprising:

a holding component configured to releasably hold at least one item; and a dispensing component in communication with the holding component, the dispensing component comprising a hatch adapted to dispense the at least one item gravitationally; and a compartment component associated with the body, the compartment component adapted to removably carry an object.

10. The interactive robotic device of claim 9, further comprising a microprocessor associated with the input component, the microprocessor adapted to perform the action upon actuation of the input component.

11. The interactive robotic device of claim 10, wherein the input component comprises a wireless input component.

12. The interactive robotic device of claim 10, wherein the input component comprises a contact input component.

13. The interactive robotic device of claim 9, wherein the output component is adapted to actuate the dispensing component to dispense the at least one item upon actuation of the output component.

* * * * *